United States Patent [19]

Liška

[11] 4,336,755

[45] Jun. 29, 1982

[54] DEVICE FOR THE AXIAL AND THE RADIAL SETTING OF THE FORM CYLINDER FOR REGISTER PRINTING

[75] Inventor: Zbyněk Liška, Adamov, Czechoslovakia

[73] Assignee: Adamovske strojirny, narodni podnik, Adamov, Czechoslovakia

[21] Appl. No.: 175,879

[22] Filed: Aug. 6, 1980

[30] Foreign Application Priority Data

Aug. 24, 1979 [CS] Czechoslovakia ..... 5753-79

[51] Int. Cl.[3] ..... B41F 13/24

[52] U.S. Cl. ..... 101/248; 74/395

[58] Field of Search ..... 101/248, 174, 178, 181, 101/180; 74/395-397, 640

[56] References Cited

U.S. PATENT DOCUMENTS

| | | | |
|---|---|---|---|
| 2,234,674 | 3/1941 | Jacobson | 101/248 X |
| 3,308,752 | 3/1967 | Stevenson | 101/248 |
| 3,565,006 | 2/1971 | Stewart | 101/248 |
| 3,641,933 | 2/1972 | Tafel | 101/248 |
| 3,750,568 | 8/1973 | Weisgerber | 101/248 |
| 3,896,724 | 7/1975 | Muselik | 101/248 |
| 4,006,685 | 2/1977 | Mosemiller | 101/248 |
| 4,137,845 | 2/1979 | Jeschke | 101/248 |
| 4,195,569 | 4/1980 | Liska | 101/248 |
| 4,207,815 | 6/1980 | Watanabe | 101/248 |

FOREIGN PATENT DOCUMENTS

| | | | |
|---|---|---|---|
| 2155334 | 7/1972 | Fed. Rep. of Germany | 101/248 |
| 2365201 | 8/1974 | Fed. Rep. of Germany | 101/248 |
| 2820287 | 11/1978 | Fed. Rep. of Germany | 101/248 |
| 327310 | 1/1958 | Switzerland | 101/248 |

*Primary Examiner*—E. H. Eickholt

*Attorney, Agent, or Firm*—Burgess, Ryan and Wayne

[57] ABSTRACT

The present invention is a device for a multicolor printing machine which permits continuous and precise axial setting of a form cylinder to obtain quality register printing during the printing operation of the machine. After setting of the form cylinder, it is also possible to eliminate clearance between the elements of the setting mechanism. The control elements are advantageously arranged on one side of the machine in such a manner as to be easily accessible for the operator. The device enables the elimination of clearance between the elements necessary for the axial setting by means of securing elements and the coupling of the drive gear with the form cylinder by means of a carrier in which the radial clearance has been eliminated and as a result, the shifting of the drive gear is made possible without introduction of radial clearance.

5 Claims, 4 Drawing Figures

31
22
21
20
19
1
13
18
15
14
11
9
39
10
38
6
27
26
36
25
30
34
14
12
29
28

DEVICE FOR THE AXIAL AND THE RADIAL SETTING OF THE FORM CYLINDER FOR REGISTER PRINTING

BACKGROUND OF THE INVENTION

The invention relates to a device for the axial and radial setting of a forme cylinder for register printing, particularly on multicolor printing machines.

The present invention provides a device for continuous and precise axial and radial setting of a forme cylinder of a printing machine to obtain register printing which can be used during the printing operation of a printing machine whereby it is possible to take up the clearance of gears in the setting mechanism. The control elements can be arranged on one side of the printing machine to provide easy control of the mechanism.

One of the known devices for the axial and radial setting of a forme cylinder for register printing consists of a pair of helical gears, one of which is rigidly connected with the forme cylinder, the second helical gear being mounted coaxially on the shaft of the forme cylinder. These gears engage a pair of connected pinions which are arranged on a shiftable countershaft, the end of which is provided with a screw which is screwed in a nut which is fixed to the side wall of the printing machine. The nut is directly or by means of an element connected with a control knob.

A disadvantage of this device is that it is necessary to use four gears for the setting of the forme cylinder, the accuracy and vibration of which have a negative influence on the color printing and register printing of the printing machine.

Another disadvantage of the mechanism is in that after the setting for register printing is achieved, the mechanism is not secured against axial shifting.

Another known device is provided with a shiftable bushing which is connected with a toothed ring mounted on the bearing of the forme cylinder. The toothed ring is in engagement with a worm gear whereby the shiftable bushing seats and is pressed by means of pressure springs on a carrier disk passing over an axial bearing on a helical drive gear which is shiftably arranged on the shaft of the forme cylinder.

A disadvantage of the described device is that it is controlled by means of a worm transmission from the front side of the machine or from another place where further clearance arises due to other transmission elements. The device forms a rigid unit, but the drive gear is controlled by elastic elements.

In another known device, a slidable bushing is arranged on a shaft of a forme cylinder. On the slidable bushing, a gear is mounted which is rigidly connected with a clearance up taking gear which is shiftably engaged with its teeth with the inner teeth of a toothed ring which is attached in a sleeve fixed on the forme cylinder.

A disadvantage of this device is that the taking up of clearance between the teeth of the gears can be carried out only before the mounting of the forme cylinder. Further taking up of the clearance of the teeth due to loosening of the forme cylinder is not possible.

A further disadvantage is that the device does not form a rigid unit so that during printing, the forme cylinder can shift.

BRIEF SUMMARY OF THE INVENTION

The arrangement will be described in relation to a right hand side but it will be obvious to one skilled in the art that the positions are arbitrary and relate to the arrangement and design of a particular printing machine.

The above disadvantages are avoided by a device according to the present invention where a left hand flange is mounted on the left hand side wall of the printing machine and on this flange is shiftably arranged a left hand toothed nut which is in engagement with a gear fixed on one end of a first gear shaft. This is rotatably mounted in a first bushing attached in the left hand side wall of the machine. In a right hand flange attached in the right hand side wall of the machine is shiftably mounted a right hand toothed nut which is in engagement with a gear fixed on a second gear shaft. Further, on a right hand shaft of the forme cylinder is arranged a shiftable bushing of a drive gear, in which is fixed a carrier pin which is mounted in a cut out provided in a side wall of the forme cylinder. On the first gear shaft is shiftably attached an indicator which is mounted on a guide pin fixed in the left hand side wall of the printing machine. On the end of the first gear shaft, there is fixed a holder with a scale showing the indication of the axial setting of the forme cylinder. On a second gear shaft is shiftably mounted an indicator indicating the radial setting of the forme cylinder, the projection of which is provided with a securing clamp which has a second recess and is provided with a second securing screw, on the second end of the second gear shaft being mounted a holder for a scale showing the radial setting of the forme cylinder.

The left hand flange is provided with a first securing screw which is mounted in the rear part of said flange which is bi-parted (divided into two parts) by a first recess. In the right hand flange of the forme cylinder, there are arranged one over the other two clearance takeup screws, the lower clearance takeup screw seating on the carrier pin of the drive gear.

An advantage of the device according to the invention is that it enables the setting of the forme cylinder for register printing during the printing operation. The setting is achieved from a control place which is easily accessible for the operator. The axial and the radial setting of the forme cylinder is carried out by means of the same elements.

A further advantage of said device is that it enables the taking-up of clearance of the gears of the mechanism which is necessary after the initial setting, by means of the securing elements, whereby the connection of the drive gear with the forme cylinder is realized by means of a carrier which is radially centered, so that the shifting of the drive gear without radial clearance is made possible.

DESCRIPTION OF THE DRAWINGS

A specific embodiment of the invention will now be described with reference to the accompanying drawings, in which.

DETAILED DESCRIPTION OF THE INVENTION

Figure 1:
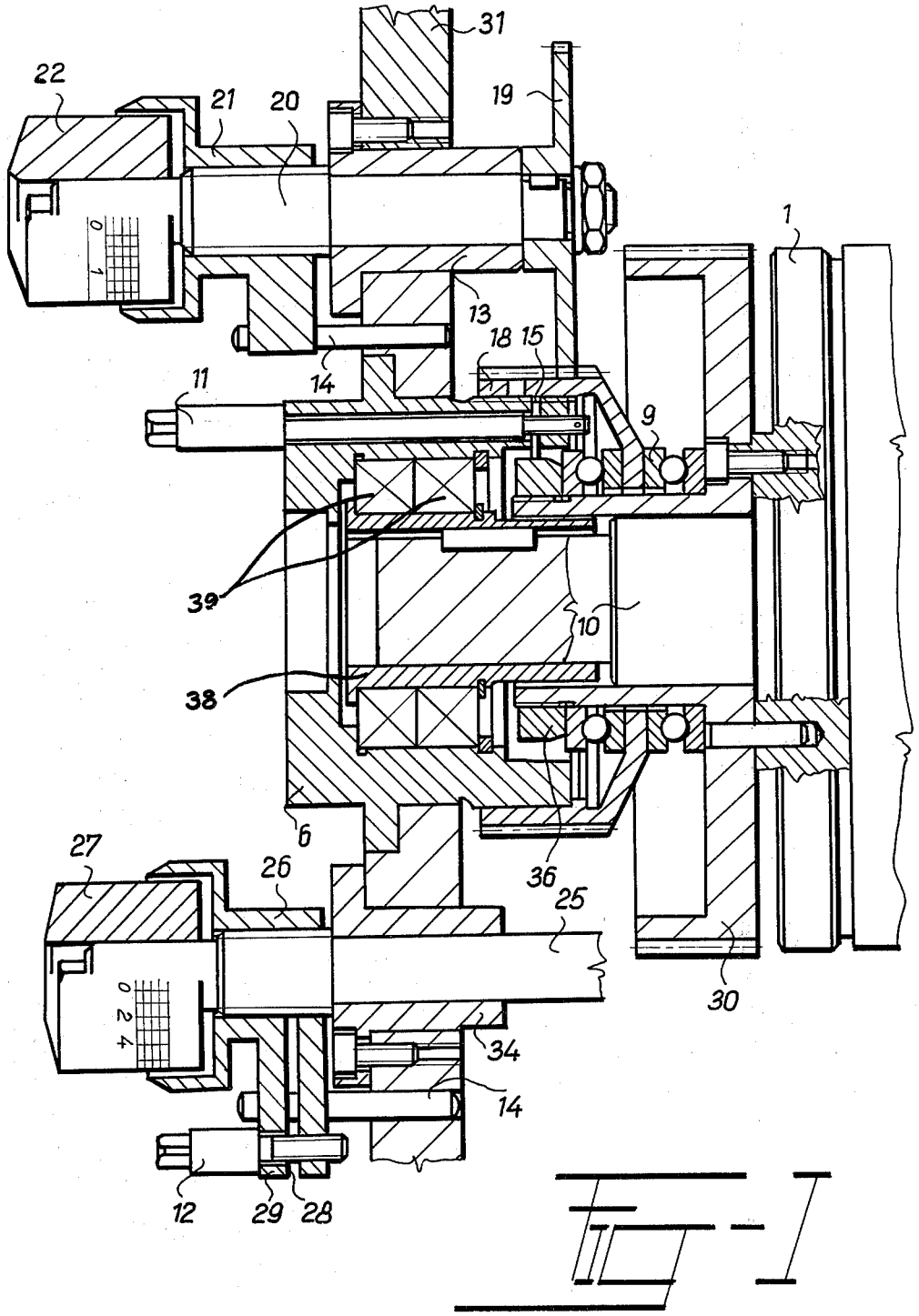
FIG. 1 illustrates a plan view of a section of the left part of the device.
Figure 2:
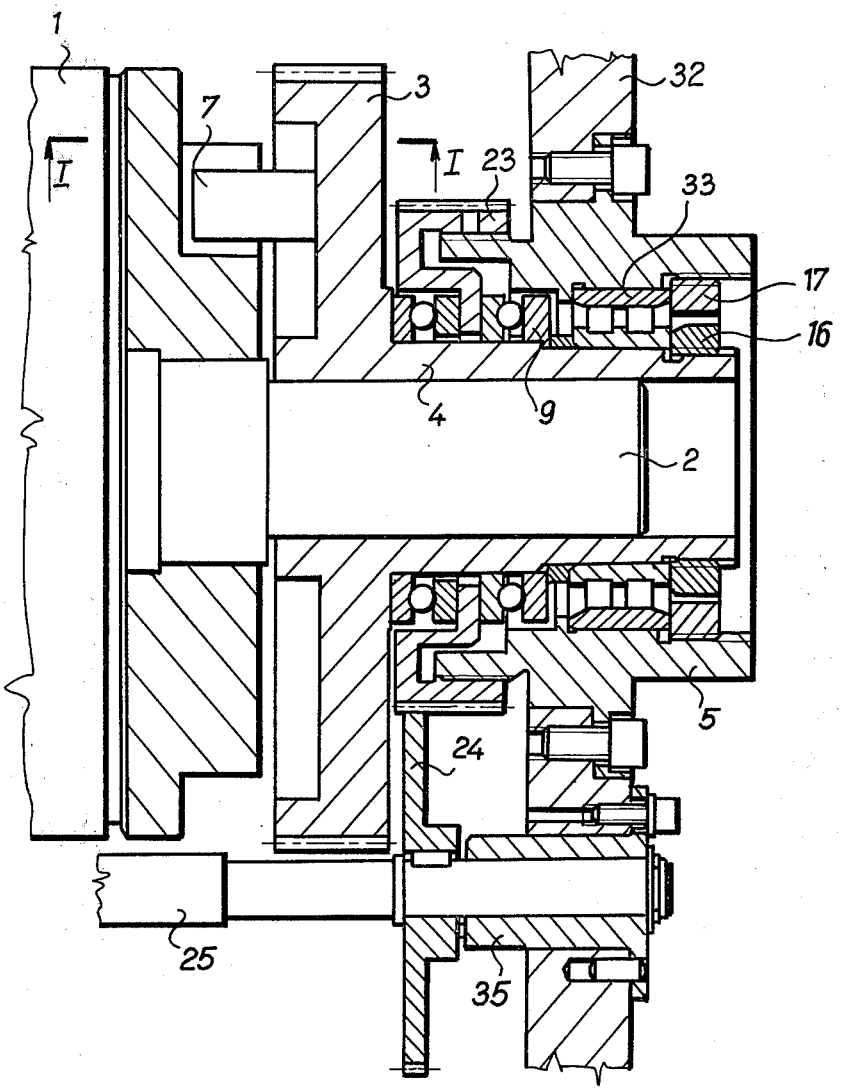
FIG. 2 shows a plane view in section of the right part of the device.
Figure 3:
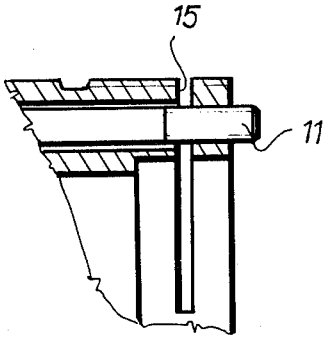
FIG. 3 shows a partial section of a detail view of the left hand flange.

The apparatus according to the present invention consists of a forme cylinder 1 which has on one side a right hand shaft 2 and on the other side a left hand shaft 10. Bushing 38 mounted on left hand shaft 10 is carried in bearings 39 mounted in left hand flange 6. On the right hand shaft 2 (FIG. 2) is mounted a drive gear 3 which is provided with a slidable bushing 4. On the drive gear 3 is fixed a carrier shaft 7 which engages with a cut out provided in the side wall of the forme cylinder 1. In the face part of the forme cylinder 1, there are mounted two clearance take-up screws 8, the lower screw of which seats on the carrier shaft 7. On the slidable bushing 4 of the drive gear are arranged axial bearings 9, between which is clamped a right hand toothed nut 23 which is screwed on the right hand flange 5. The drive gear 3 is provided with helical toothing. The right hand toothed nut 23 engages with a right hand gear 24 which is fixed on a second shaft 25. The left hand end of the second shaft 25 is mounted in a second bushing 34 which is fixed in the left hand side wall of the printing machine. The right hand end of the second shaft is mounted in an eccentric bushing 35 which is attached in the right hand bushing 32. On the left hand end of the second shaft 25 (FIG. 1) is attached an indicator 26 for indication of the radial setting of the forme cylinder 1, which indicator is provided with a securing clamp 29 in which is provided a second cut out 28. In the securing clamp 29 of the indicator 26 is located a securing screw 12 and a guide pin 14 which is fixed in the left hand side wall 32 of the machine. On the left hand end of the second shaft 25, in front of the indicator 26 is mounted a carrier 27 for a scale showing the radial setting of the forme cylinder 1. On the left hand side wall 31 (FIG. 1) is fixed a left hand flange 6, on the end of which is provided a first recess 15 with the function for the engagement of the securing clamp. In the left hand flange is mounted a securing screw 11 which is screwed into the rear part of the flange 6 which is divided by the first recess 15. On the left hand flange 6 is screwed a left hand toothed nut 18 which is located between two axial bearings 9 which are mounted on a hub of a gear 30. The axial bearings 9 are secured on the hub of the gear 30 by means of securing nut 36. The teeth of the left hand nut 18 engage with the left hand gear 19 which is fixed on a first shaft 20. The first shaft 20 is rotatably mounted in the left hand side wall 31 of the machine.

On the end portion of the shaft 20 is secured an indicator 21 for the indication of the axial setting of the forme cylinder and a carrier 22 for the scale showing the axial setting of the forme cylinder. In a procession of the indicator 21, there is arranged a guide pin 14 which engages the left hand side wall of the machine. On the right hand side wall 32 of the printing machine is fixed a right hand flange 5, in which is mounted a radial bearing 33 which is arranged on a slidable bushing 4 of the drive gear 3. The inner ring of the radial bearing 33 is secured on the slidable bushing 4 of the drive gear 3. The inner ring of the radial bearing 33 is secured on a slidable bushing 4 of the drive gear 3 by means of an inner toothed nut 16. The outer ring of the radial bearing 33 is secured on the slidable bushing 4 of the drive gear 3 by means of an inner toothed nut 16. The outer ring of the radial bearing 33 is secured in a right hand flange 5 by means of an outer nut 17.

The device according to the invention functions as follows:

The radial turning of the forme cylinder 1 to a position to obtain register printing is carried out by manual turning of the second shaft 25 by means of a T-key. Simultaneously with turning of the second shaft 25, the right hand gear 24 is turned which turns the right hand toothed nut 23 and shifts the toothed nut 23 on the right hand flange 5. Simultaneously with the shifting of the right hand toothed nut 23, the drive gear 3 is also shifted. The drive gear 3 is provided with helical toothing which is in engagement with helical gear (not illustrated). Since the aforesaid helical gear which is engaged with drive gear 3 is secured against turning, the drive gear 3 is turned and turns the forme cylinder 1 by means of the carrier shaft 7. After the radial setting of the forme cylinder 1, the mechanism is secured by a second securing screw 12.

The clearance between the right hand gear 24 and the right hand toothed nut 23 is taken up during the mounting operation by turning the eccentric bushing 35. After the setting of clearance, the position of the eccentric bushing 35 is secured by means of a pin. The range of the radial turning of the drive gear 3 is given by the value of the clearance which is set during mounting between the rear part of the holder 27, the second bushing 34 and the rear face of the indicator 26 for indicating the radial setting of the forme cylinder 1. (See FIG. 1).

Figure 4:
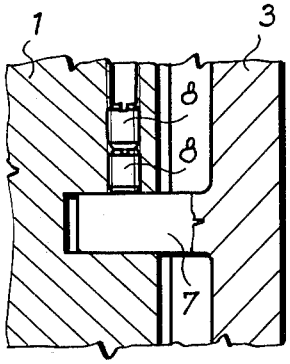
FIG. 4 illustrates in section a detail of the carrier, seen in a plane I—I of FIG. 2.

The adjustable radial clearance between the carrier shaft 7 and the forme cylinder 1 is taken up by means of clearance take-up screws 8. (See FIG. 4).

The axial setting of the forme cylinder 1 for register printing is achieved by turning of the first shaft 20, which turns the gear 19 which engages the left hand toothed nut 18. The left hand toothed nut 18 is shifted on the left hand flange 6 and pushes the forme cylinder 1 over by means of pressure against the axial bearing 9, whereby the forme cylinder 1 is axially shifted.

After the axial setting of the forme cylinder 1 for register printing, the whole mechanism is secured by means of the securing screw 11. The range of the axial setting of the forme cylinder 1 is determined by the setting of the clearance between the rear face of the carrier 22 of the scale showing the axial setting of the forme cylinder 1 and the front face of the indicator 21, and further, by the clearance between the wall of the first bushing 13 and the rear face of the indicator 21 indicating the axial setting of the forme cylinder 1.

What is claimed is:

1. A device for the axial and radial setting of the forme cylinder for register printing during printing operation, particularly on multicolor printing machines, which comprises: a first shaft mount, for engaging a first shaft of a forme cylinder, mounted in a first side wall of a printing machine; a first toothed nut shiftingly arranged on said first shaft mount in engagement with a first gear fixed to a first gear shaft turnably arranged in the first side wall of the printing machine and in a bearing arrangement with said forme cylinder for axially adjusting the position of the forme cylinder, said first shaft mount having a recess and a securing screw which cooperate to form a securing clamp for securing the axial setting of said forme cylinder; a second shaft mount, which engages a second shaft of the forme cylinder, mounted in a second sidwall of the printing machine, a second toothed nut shiftably arranged on said second shaft mount in engagement with a second gear fixed on a second gear shaft, a slideable drive gear, bearingly in communication with said second toothed nut and having a carrier pin which engages a recess provided in the side wall of the forme cylinder, mounted on said second shaft of said forme cylinder whereby the radial setting of said forme cylinder is adjusted.

2. A device of claim 1 wherein said first gear shaft further comprises an arrangement of said first gear shaft for indicating the axial setting of the forme cylinder which comprises an indicator having a projection mounted on a guide pin in the first sidewall of the printing machine and a scale carrier mounted on said first gear shaft for showing the axial setting of the forme cylinder.

3. A device of claim 1 wherein said second gear shaft further comprises an arrangement of said second gear shaft for indicating the radial setting of the forme cylinder which comprises an indicator, provided with a projection, mounted on a securing clamp having a pin which is mounted on the first sidewall of the printing machine, the securing clamp having a cut out with two side portions and a securing screw arranged to urge the side portions together, and a scale carrier mounted on said second gear shaft to show the radial setting of the forme cylinder.

4. A device of claim 3 wherein an end of the second gear shaft is arranged in an eccentric bushing fixed in the second side wall of the printing machine whereby clearance between the second gear and the second toothed nut can be adjusted.

5. A device of claim 1 wherein a set screw which bears against the carrier pin is mounted in the forme cylinder to set the relative positions of the forme cylinder and the carrier pin.

* * * * *